United States Patent [19]

Graf et al.

[11] Patent Number: 5,017,094

[45] Date of Patent: May 21, 1991

[54] SOLENOID VALVE CONTROL SYSTEM FOR HYDROSTATIC TRANSMISSION

[75] Inventors: Kevin J. Graf; James J. Hastreiter, both of Eden Prairie; Duane A. Anderson, Edina, all of Minn.

[73] Assignee: Eaton Corporation, Cleveland, Ohio

[21] Appl. No.: 491,776

[22] Filed: Mar. 12, 1990

[51] Int. Cl.[5] ..... F04B 49/06; F04B 1/26

[52] U.S. Cl. ..... 417/218; 417/222; 91/506

[58] Field of Search ..... 417/218, 222, 219, 220, 417/221; 91/506; 60/403, 431, 388, 395

[56] References Cited

U.S. PATENT DOCUMENTS

| | | | |
|---|---|---|---|
| 3,529,422 | 9/1970 | Herndon | 60/53 |
| 3,924,410 | 12/1975 | Cornell | 60/403 |
| 3,935,707 | 2/1976 | Murphy | 417/218 |
| 4,107,924 | 8/1978 | Dezelan | 417/218 |
| 4,194,361 | 3/1980 | Pahl | 60/388 |
| 4,244,678 | 1/1981 | Uehara | 417/218 |
| 4,274,257 | 6/1981 | Koch | 60/431 |
| 4,282,711 | 8/1981 | Branstetter | 60/395 |
| 4,408,453 | 10/1983 | Westveer | 417/218 |
| 4,810,171 | 3/1989 | Krebs | 417/218 |
| 4,823,552 | 4/1989 | Ezell | 417/218 |

*Primary Examiner*—Leonard E. Smith
*Assistant Examiner*—Peter Korytnyk
*Attorney, Agent, or Firm*—L. J. Kasper

[57] ABSTRACT

A control system (33, 41) is disclosed of the type used to control the displacement of a variable displacement pump (11) having stroking cylinders (25, 27). The control system includes a pair of ON-OFF electromagnetic valves (49, 51) and a proportional valve (85). When a first direction of operation is selected, a first direction command signal (43) is transmitted to the first ON-OFF valve (40) such that control pressure from the charge pump (17) flows through the valve (49), then through the proportional valve (85) and through the valve (51) to the reservoir (75) until the proportional valve (85), in response to an increasing displacement signal (47), moves from its minimum displacement position (FIG. 1) toward a position corresponding to the desired displacement of the pump. With the control system of the present invention, two of the three electromagnetic valves (49, 51, 85) would have to fail, such as being stuck in an open position, in order for the vehicle operator to be unable to bring the vehicle to a safe stop.

7 Claims, 3 Drawing Sheets

SOLENOID VALVE CONTROL SYSTEM FOR HYDROSTATIC TRANSMISSION

BACKGROUND OF THE DISCLOSURE

The present invention relates to control systems for variable displacement hydraulic units, and more particularly to such control systems which operate in response to electrical input signals.

Hydrostatic transmissions, consisting of a variable displacement pump and either a fixed or variable displacement motor, would be a typical use for the control system of the present invention. The variable pump typically has a pair of stroking cylinders and a charge pump which generates control pressure. The control system communicates control pressure to either the first or second stroking cylinder to displace the swash plate of the pump, from neutral, in either a first direction or a second direction. Typically, the first direction of operation of the pump would correspond to forward movement of the vehicle, whereas the second direction of operation would correspond to reverse movement of the vehicle.

The most common type of electrohydraulic servo for controlling the flow of control pressure to the stroking cylinders has been the nozzle-flapper servo, which provides precise, responsive control, but is quite expensive.

It is also known to those skilled in the art to use various arrangements of solenoid valves, both the ON-OFF type, and the proportional type. See for example U.S. Pat. No. 3,529,422. Such systems typically suffer from one of two possible disadvantages. Either the system utilizes two proportional solenoid valves, in which case the system again becomes quite expensive, or only the ON-OFF type solenoid valves are used, in which case the system is typically arranged such that one of the solenoid valves becoming stuck in the open position may result in the vehicle operator being unable to bring the pump back to neutral, and bring the vehicle to a safe stop.

SUMMARY OF THE INVENTION

Accordingly, it is an object of the present invention to provide an improved control system which is relatively inexpensive, but which is highly "failsafe", in that the ability to return the pump to neutral is lost only if at least two of the solenoid valves in the system fail at the same time.

It is a more specific object of the present invention to provide an improved control system which achieves the above-stated object, but which requires only a single solenoid valve of the type which is effectively proportional in operation, in order to achieve the relatively smooth operation which is desirable.

The above and other objects of the present invention are accomplished by the provision of a control system for use with a variable displacement hydraulic unit having first and second fluid operable means for varying the displacement of the unit in response to variations in an electrical input signal. The system has a source of control fluid pressure and a reservoir and first and second ON-OFF electromagnetic valves. The first ON-OFF valve has an inlet adapted for fluid communication with the source of control fluid pressure, and an outlet adapted for fluid communication with the first fluid operable means. The second ON-OFF valve has an inlet adapted for fluid communication with the source of control fluid pressure and an outlet adapted for fluid communication with the second fluid operable means. The control system includes logic control means operable in response to the electrical input signal to generate first and second direction command signals and transmit said command signals to the first and second ON-OFF valves, respectively.

The improved control system is characterized by a third electromagnetic valve having first and second ports, the first port being in communication with the outlet of the first ON-OFF valve and the second port being in communication with the outlet of the second ON-OFF valve. The logic control means is operable to generate a displacement signal representative of the desired displacement of the hydraulic unit, and to transmit the displacement signal to the third valve. The first and second ON-OFF valves each have a drain port and a valve member movable in response to the first and second direction command signals, respectively, to a position permitting fluid communication from the inlet to the outlet, and blocking fluid communication from the outlet to the drain port. In response to the direction command signal being OFF, the valve member is movable to a position permitting fluid communication from the outlet to the drain port, and blocking fluid communication from the inlet to the outlet. The third electromagnetic valve includes a valve member movable in response to variations in the displacement signal, between a minimum displacement position in which the first and second ports are in relatively unrestricted fluid communication with each other, and a maximum displacement position in which the first and second ports are substantially prevented from fluid communication with each other.

DESCRIPTION OF THE PREFERRED EMBODIMENT

Figure 1:
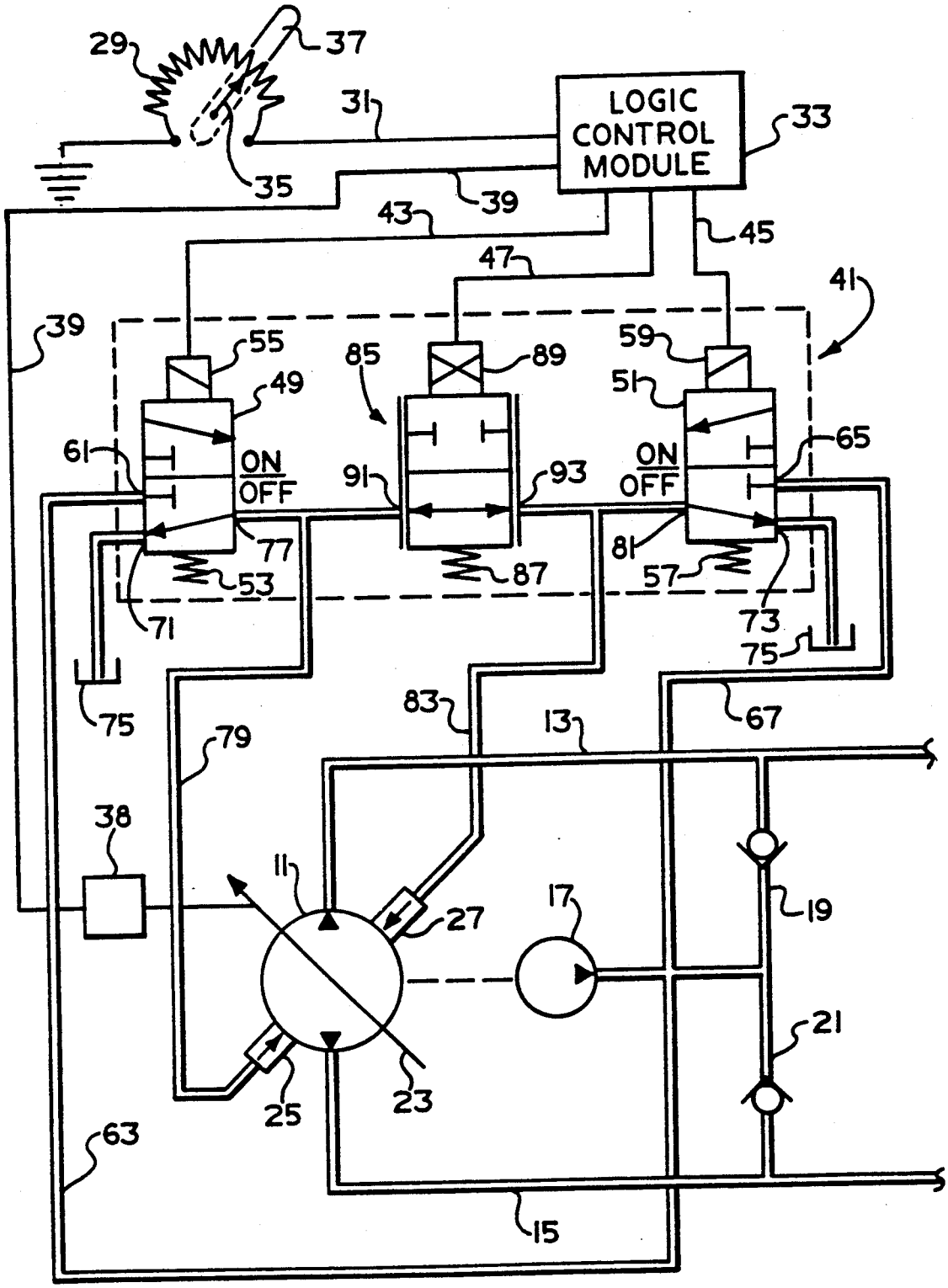
FIG. 1 is a schematic illustration of a variable displacement hydraulic pump including the improved control system of the present invention.

Referring now to the drawings, which are not intended to limit the invention, FIG. 1 illustrates schematically a variable displacement hydraulic pump 11, preferably of the axial piston type, hydraulically connected to a hydraulic motor (not shown in FIG. 1) by means of a pair of conduits 13 and 15. Typically, the motor is of the fixed displacement type, although the motor may be of the variable displacement type, and the control system of the present invention may then be applied to control the displacement of the motor.

Input power to the pump 11 is supplied by any suitable power source (not shown) to drive the rotating group of the pump 11, and also to drive a charge pump 17. One function of the charge pump 17 is to supply make-up fluid to whichever of the conduits 13 or 15 is the low-pressure side of the system, the charge pump 17 being in fluid communication with the conduit 13 by means of a conduit 19, and being in communication with the conduit 15 by means of a conduit 21.

The pump 11 includes a swashplate, indicated schematically at 23, which is movable over-center, in a known manner, by a pair of stroking cylinders 25 and 27. Various other standard controls, such as relief valves, etc., which are well known in the art, and form no part of the present invention, have been omitted from FIG. 1 and from the description.

In the embodiment of the control system of the present invention, the operator selects the desired direction and displacement of the pump 11 by means of any suitable control, represented schematically in FIG. 1 by a manual input potentiometer 29, the function of which is to generate an electrical input signal which is transmitted by a lead 31 to a logic control module 33. Hereinafter, each electrical signal and its respective electrical lead, are referred to by the same reference numeral. The potentiometer 29 includes a movable wiper 35, the position of which may be varied by means of a manual input lever, represented schematically at 37. As is well known to those skilled in the art, whenever the wiper 35 is moved to a particular position, to select a desired displacement of the pump 11, the swashplate 23 moves to the desired position, with such movement of the swashplate being transmitted by means of a feedback potentiometer, shown schematically at 38. The feedback potentiometer 38 may be constructed in generally the same manner as the potentiometer 29, but preferably, has its wiper moved by a link on the swashplate 23, instead of by the operator. The logic control module 33 compares the input signal 31 with the actual location of the swashplate, as is indicated by a feedback signal 39, from the potentiometer 38. As is also well known to those skilled in the art, the previous reference herein to selecting the direction of operation of the pump 11 refers to pressurizing either the stroking cylinder 25 to move the swashplate off-center in a first direction, so that conduit 13 is pressurized, or pressurizing the stroking cylinder 27, to move the swashplate 23 off-center in a second direction, so that the conduit 15 is pressurized.

Referring still to FIG. 1, the logic control module 33 receives the electrical input signal 31 and generates three separate command signals, which comprise the electrical inputs to a control valve assembly, generally designated 41. If the operator moves the wiper 35 to select a first direction of operation, the input signal 31 is translated into a first direction command signal 43, whereas, if the operator moves the wiper 35 to select the second direction of operation, the input signal 31 is translated into a second direction command signal 45. At the same time, the magnitude of the input signal 31, with respect to the neutral position, is translated by the logic control module 33 into a displacement signal 47. The manner in which the signals 43, 45, and 47 are used to control the displacement of the pump 11 will be described in greater detail subsequently. It is believed that the details of logic control module 33 would be well within the ability of one skilled in the art, and because such details do not form an essential part of the present invention, they will not be described further herein.

Referring still to FIG. I, the control valve assembly 41 includes a pair of "ON-OFF" electromagnetic valves 49 and 51. The valve 49 is biased by means of a spring 53 to an "OFF" position, but may be biased toward an "ON" position whenever electromagnetic coil 55 receives the first direction command signal 43. Similarly, the ON-OFF valve 51 is biased to an "OFF" position by means of a spring 57, but may be biased toward an "ON" position whenever an electromagnetic coil 59 receives the second direction command signal 45.

The ON-OFF valve 49 includes an inlet 61 which receives control fluid pressure from the charge pump 17 by means of a conduit 63, while the ON-OFF valve 51 includes an inlet 65 which receives control fluid pressure from the charge pump 17 by means of a conduit 67. The valve 49 includes a drain port 71, while the valve 51 includes a drain port 73, both of the ports 71 and 73 being in open communication with a system reservoir 75.

The ON-OFF valve 49 includes an outlet 77 which is in fluid communication with the stroking cylinder 25 by means of a conduit 79. Similarly, the ON-OFF valve 51 includes an outlet 81 which is in open communication with the stroking cylinder 27 by means of a conduit 83.

The control valve assembly 41 also includes a proportional electromagnetic valve 85 which is biased toward a minimum pump displacement position by means of a spring 87, but may be biased toward a maximum pump displacement position by means of an electromagnetic coil 89. In the subject embodiment, the position of the proportional valve 85, between the minimum and maximum pump displacement positions, is proportional to the displacement signal 47 which is transmitted to the coil 89.

The proportional valve 85 includes a first port 91 and a second port 93. The first port 91 is in open communication with the outlet 77 of the ON-OFF valve 49, while the second port 93 is in open communication with the outlet 81 of the ON-OFF valve 51. Although the valve 85 is illustrated herein as being a proportional valve, responsive to a displacement signal 47 whose magnitude is proportional to desired displacement of the pump 11, it should be apparent to one skilled in the art that the valve 85 could also comprise an ON-OFF valve, in which case the displacement signal 47 would comprise a PWM (pulse width modulated) signal. As is well known to those skilled in the art, the duty cycle of the PWM signal would vary between 0% and 100%, representative of the desired rate of change of pump displacement. A suitable circuit arrangement for generating such a PWM signal is illustrated and described in greater detail in U.S. Pat. No. 4,274,257, assigned to the assignee of the present invention, and incorporated herein by reference.

Figure 2:
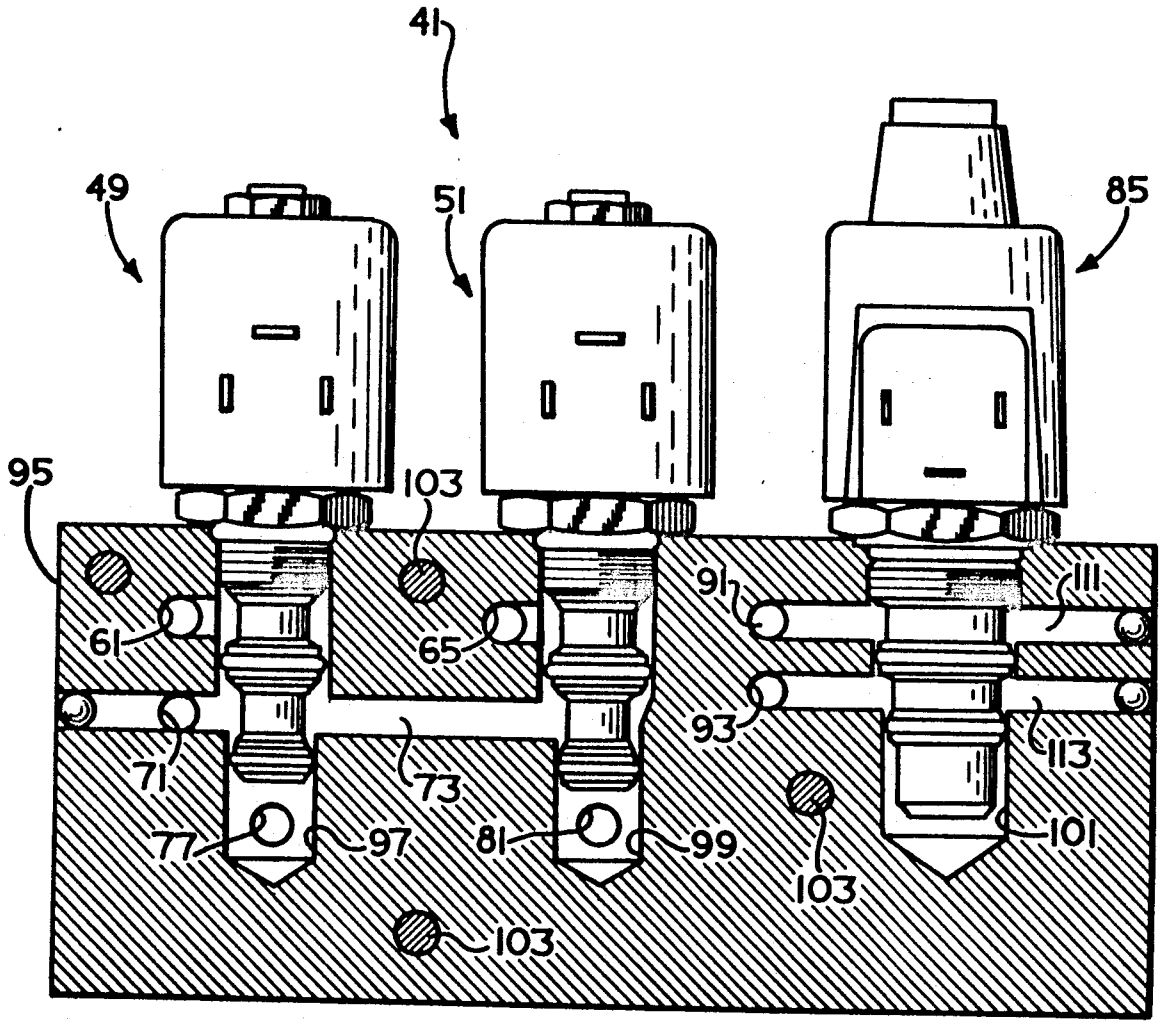
FIG. 2 is a cross-section of the valve assembly shown schematically in FIG. 1.

Referring now primarily to FIG. 2, the control valve assembly 41 of the present invention is illustrated in cross-section. The valve assembly 41 includes a main valve block 95 which defines a pair of substantially identical, stepped bores 97 and 99, which receive the ON-OFF valves 49 and 51, respectively. The valve block 95 also defines a stepped bore 101 which receives the proportional valve 85.

Figure 3:
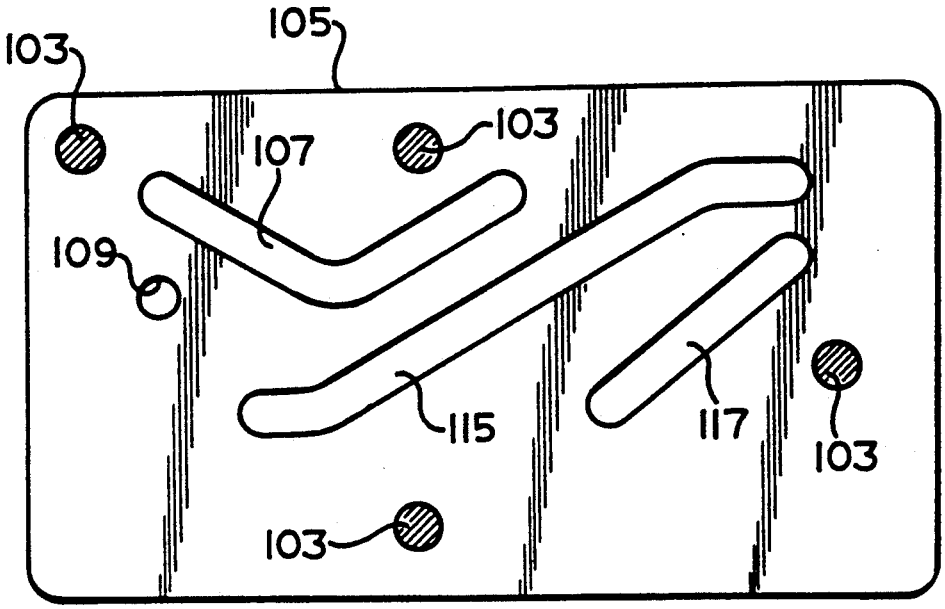
FIG. 3 is a top plane view of a gasket member to be disposed between the valve assembly of the present invention and the hydraulic pump.

Referring now to FIG. 3, in conjunction with FIG. 2, the valve assembly 41 is attached to an upper surface of the housing of the pump 11 by means of a plurality of bolts 103, and disposed between the valve block 95 and the pump 11 is a gasket member 105, the function of which will become apparent from the subsequent description. The valve block 95 defines the inlet 61 and the inlet 65, which were shown schematically in FIG. 1 as being fed by separate conduits 63 and 67, but preferably, are both in communication with the charge pump 17 by means of a V-shaped opening 107 in the gasket member 105.

The valve block 95 defines the drain port 71, which communicates through a drain opening 109 in the gasket member 105 with the system reservoir 75, which may comprise the case drain region of the pump 11. The valve block 95 also defines the drain port 73, illustrated herein as a transverse passage which communicates with the drain port 71.

The valve block 95 further defines the outlet 77, intersecting the stepped bore 97, and the outlet 81 intersecting the stepped bore 99. Finally, the valve block 95 defines a pair of transverse bores 111 and 113, each of which intersects the stepped bore 101, the bore 111 communicating with the first port 91, and the bore 113 communicating with the second port 93. The outlet 77 is in open communication with the first port 91 by means of an angled opening 115 defined by the gasket member 105, while the outlet 81 is in open communication with the second port 93 by means of an angled opening 117, also defined by the gasket member 105. The opening 115 is in fluid communication with the conduit 79, leading to the stroking cylinder 25, while the opening 117 is in communication with the conduit 83, leading to the stroking cylinder 27.

Figure 4:
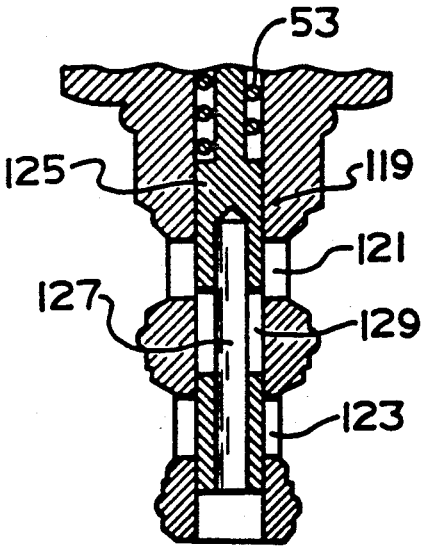
FIGS. 4 and 5 are fragmentary, somewhat schematic, cross-section views of the solenoid valves which comprise part of the valve assembly of the present invention.

Referring now to FIG. 4, the ON-OFF valve 49 will be described in some detail, it being understood that the ON-OFF valve 51 may be substantially identical, and therefore, will not be separately described herein. The ON-OFF valve 49, shown only fragmentarily in FIG. 4, includes an outer casing portion 119 defining a pair of lateral openings 121 and 123, which are in open communication with the inlet 61 and the drain port 71, respectively. Disposed within the casing portion 119 is a spool member 125 defining an axial opening 127 and a pair of radial openings 129. The spool member 125 is biased downwardly in FIGS. 2 and 4 by the spring member 53, toward a position permitting fluid communication from the outlet 77 to the drain port 71. Actuation of the coil 55 by means of the command signal 43 moves the spool member 25 upward in FIG. 4, overcoming the biasing force of the spring 53, to a position in which there is open communication from the inlet 61 to the outlet 77.

Figure 5:
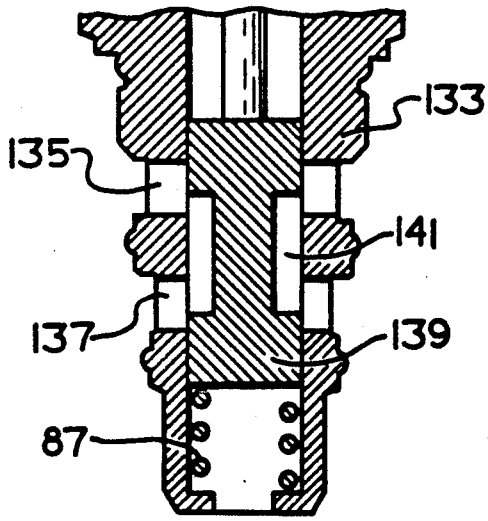

Referring now to FIG. 5, the proportional, electromagnetic valve 85 will be shown in greater detail. The valve 85, also shown fragmentarily in FIG. 5, includes an outer casing portion 133 which defines a pair of lateral openings 135 and 137. Disposed within the casing portion 133 is a spool member 139 which is biased upwardly in FIGS. 2 and 5 by means of the spring member 87. The spool member 139 defines a reduced diameter portion 143 disposed to provide communication between the lateral openings 135 and 137, the amount of communication provided therebeteween depending upon the position of the spool member 139. The spring 87 biases the spool member 139 toward a position in which the portion 141 permits relatively unrestricted communication between the openings 135 and 137. As the magnitude of the displacement signal 47 increases, the spool member 139 is biased further downwardly in FIG. 5, gradually restricting the communication between the openings 135 and 137.

Operation

The operation of the improved control system will now be described, with reference to all of the drawing figures. When the operator moves the input lever 37 to a position to select, for example, the first direction of operation, the logic control module 33 receives an appropriate input signal 31 and generates the first direction command signal 43 in the ON condition, and at the same time, generates the second direction command signal 45 in the OFF condition. As a result, the coil 55 of the first ON-OFF valve 49 is actuated, biasing the spool member 125 to the position permitting fluid communication from the inlet 61 to the outlet 77. At the same time, the coil 59 of the ON-OFF valve 51 is unactuated, and the spring 57 biases the valve 51 to the position shown in FIG. 1 in which the outlet 81 is in communication with the drain port 73.

Initially, after the operator selects the desired displacement by positioning the lever 37, the proportional valve 85 is in the position shown in FIG. 1 in which the spool member 139 provides relatively unrestricted communication through the lateral openings 135 and 137 between the first port 91 and the second port 93. As a result, the control pressure from the charge pump 17 flows through the conduit 63, through the ON-OFF valve 49 to the outlet 77, then through the angled opening 115 to the first port 91. While the valve 85 is still in the position shown in FIG. 1, the charge pressure then flows through the valve 85 to the second port 93, then through the angled opening 117 to the outlet 81, then through the ON-OFF valve 51 to the drain port 73, and then to the system reservoir.

As the magnitude (or duty cycle) of the displacement signal 47 increases, actuating the coil 89 to overcome the spring 87, the spool member 139 moves away from the position shown in FIG. 1 (i.e., downwardly in FIG. 5) toward a position blocking communication between the ports 91 and 93. The result is that pressure begins to build at the first port 91 and in the angled opening 115 of the gasket member 105, thus also building pressure in the conduit 79 and stroking cylinder 25.

One of the primary advantages of the control system of the present invention is the exceptionally smooth and precise control which can be achieved by using the ON-OFF valves 49 and 51 to select the direction of operation first, with the proportional valve 85 then being actuated to command displacement of the pump 11.

If the control system of the present invention is being used in association with a hydrostatic transmission whose function is to propel a vehicle, control of the vehicle can be lost only if two of the three valves within the valve assembly 41 fail at the same time. When the operator has selected a first direction of operation in accordance with the above example, and a first direction command signal 43 is being transmitted to the ON-OFF valve 49, the operator would not lose control of the vehicle if the spool member 125 were to stick in the "ON" position, while the operator is returning the lever 37 to the neutral position. Once the wiper 35 has been returned to neutral, the displacement signal 47 is reduced to zero voltage (or 0% duty cycle), and the proportional valve 85 returns to the minimum displacement position shown in FIG. 1, and the pump 11 returns to neutral displacement, even though the ON-OFF valve 49 has not returned to its "OFF" position.

Similarly, if the spool member 139 of the proportional valve 85 sticks in the maximum displacement position, while the operator is returning the lever 37 to neutral, control of the vehicle is not lost. The first direction command signal 43 is changed from an "ON" position to an "OFF" condition when the wiper 35 returns to neutral, such that the ON-OFF valve 49 moves from its "ON" position to its "OFF" position shown in FIG. 1. Therefore, both of the stroking cylinders 25 and 27 are in communication with the system reservoir 75 and the pump 11 returns to neutral. With the present invention, the vehicle operator would be unable to stop the vehicle only if both the ON-OFF valve 49 and the proportional valve 85 would become stuck in the "ON" and maximum displacement positions, respectively.

The invention has been described in great detail sufficient to enable one skilled in the art to make and use the same. It is apparent that various alterations and modifications of the invention will become apparent to those skilled in the art upon a reading and understanding of the foregoing specification, and it is intended to include all such alterations and modifications as part of the invention, insofar as they come within the scope of the appended claims.

We claim:

1. A control system for use with a variable displacement hydraulic unit having first and second fluid operable means for varying the displacement of said unit in response to variations in an electrical input signal, said sYstem having a source of control fluid pressure, and a reservoir; said control system comprising first and second ON-OFF electromagnetic valves, said first ON-OFF valve having an inlet adapted for fluid communication with said source of control fluid pressure, and an outlet adapted for fluid communication with said first fluid operable means, said second ON-OFF valve having an inlet adapted for fluid communication with said source of control fluid pressure, and an outlet adapted for fluid communication with said second fluid operable means; said control system including logic control means operable, in response to said electrical input signal, to generate first and second direction command signals and transmit said command signals to said first and second ON-OFF valves, respectively; characterized by:

(a) a third electromagnetic valve having first and second ports, said first port being in fluid communication with said outlet of said first ON-OFF valve, and said second port being in fluid communication with said outlet of said second ON-OFF;

(b) said logic control means being operable to generate a displacement signal representative of desired displacement of said hydraulic unit, and to transmit said displacement signal to said third valve;

(c) said first ON-OFF valve having a drain port and a valve member movable, in response to said first direction command signal being ON, to a position permitting fluid communication from said inlet to said outlet, and blocking fluid communication from said outlet to said drain port, and in response to said first direction command signal being OFF, to a position permitting fluid communication from said outlet to said drain port, and blocking fluid communication from said inlet to said outlet;

(d) said second ON-OFF having a drain port and a valve member movable, in response to said second direction command signal being ON, to a position permitting fluid communication from said inlet to said outlet, and blocking fluid communication from said outlet to said drain port, and in response to said second signal being OFF, to a position permitting fluid communication from said outlet to said drain port, and blocking fluid communication from said inlet to said outlet; and (e) said third electromagnetic valve including a valve member movable, in response to variations in said displacement signal, between a minimum displacement position (FIG. 1) in which said first and second ports are in relatively unrestricted fluid communication with each other, and a maximum displacement position in which said first and second ports are substantially prevented from fluid communication with each other.

2. A control system as claimed in claim 1 characterized by said third electromagnetic valve comprising a proportional valve wherein the position of said valve member between said minimum and maximum displacement positions is proportional to said displacement signal.

3. A control system as claimed in claim 2 characterized by said logic control means being operable, when said electrical input signal indicates operation in a first direction, to generate said first direction command signal ON, and to generate said second direction command signal OFF.

4. A control system as claimed in claim 3 characterized by said third electromagnetic valve and said second ON-OFF valve, being operable to communicate from said outlet of said first ON-OFF valve to said outlet of said second ON-OFF valve, and from said outlet to said drain port, said control fluid pressure in excess of the pressure required to maintain said desired displacement of said hydraulic unit.

5. A control system as claimed in claim 2 characterized by said logic control means being operable, when said electrical input signal indicates operation in a second direction, to generate said first direction command signal OFF and to generate said second direction command signal ON.

6. A control system as claimed in claim 5 characterized by said third electromagnetic valve and said first ON-OFF valve being operable to communicate from said outlet of said second ON-OFF valve to said outlet of said first ON-OFF valve, and from said outlet to said drain port, said control fluid pressure in excess of the pressure required to maintain said desired displacement of said hydraulic unit.

7. A control system for use with a variable displacement hydraulic unit having first and second fluid operable means for varying the displacement of said unit in response to variations in an electrical input signal, said system having a source of control fluid pressure, and a reservoir; said system comprising first and second ON-OFF electromagnetic valves, said first ON-OFF valve having an inlet adapted for fluid communication with said source of control fluid pressure, and an outlet adapted for fluid communication with said first fluid operable means, said second ON-OFF valve having an inlet adapted for fluid communication with said source of control fluid pressure, and an outlet adapted for fluid communication with said second fluid operable means; said control system including logic control means operable, in response to said electrical input signal indicating operation of said unit in a first direction, to generate a first direction command signal in a first condition and a second direction command signal in a second condition, and further operable, in response to said electrical input signal indicating operation of said unit in a second direction, to generate said first direction command signal in a second condition and said second direction command signal in a first condition, and to transmit said first and second direction command signals to said first and second ON-OFF valves, respectively; characterized by:

(a) a proportional electromagnetic valve having first and second ports, said first ports being in fluid communication with said outlet of said first ON-OFF valve, and said second port being in fluid communication with said outlet of said second ON-OFF valve;

(b) said logic control means being operable to generate a displacement signal representative of desired displacement of said unit, and to transmit said displacement signal to said proportional valve;

(c) said proportional valve including a valve member movable, in response to variations in said displacement signal, between a minimum displacement position (FIG. 1) in which said first and second ports are in relatively unrestricted fluid communication with each other, and a maximum displacement position, in which said first and second ports are substantially prevented from fluid communication with each other;

(d) said first and second ON-OFF valves defining a first fluid path in response to said first direction command signal being in said first condition and said second direction command signal being in said second condition, and providing fluid communication from said source of control fluid pressure to said reservoir, said first fluid path being restricted by said proportional valve, said restriction of said first fluid path being generally inversely proportioned to said displacement signal; and (e) said first and second ON-OFF valves defining a second fluid path in response to said first direction command signal being in said second condition and said second direction command signal being in said first condition, and providing fluid communication from said source of control fluid pressure to said reservoir, said second fluid path being restricted by said proportional valve, said restriction of said second fluid path being generally inversely proportional to said displacement signal.

* * * * *